US010792664B2

(12) United States Patent
Hoogendoorn

(10) Patent No.: US 10,792,664 B2
(45) Date of Patent: Oct. 6, 2020

(54) IMPACT BAR

(71) Applicant: KEESTRACK N.V., Munsterbilzen (BE)

(72) Inventor: Frederik Hoogendoorn, Bilzen (BE)

(73) Assignee: KEESTRACK N.V., Munsterbilzen (BE)

( * ) Notice: Subject to any disclaimer, the term of this patent is extended or adjusted under 35 U.S.C. 154(b) by 124 days.

(21) Appl. No.: 16/010,048

(22) Filed: Jun. 15, 2018

(65) Prior Publication Data

US 2019/0015838 A1 Jan. 17, 2019

(30) Foreign Application Priority Data

Jun. 16, 2017 (DE) ..... 10 2017 113 238

(51) Int. Cl.
*B02C 13/06* (2006.01)
*B02C 13/28* (2006.01)

(52) U.S. Cl.
CPC ..... *B02C 13/2804* (2013.01); *B02C 13/06* (2013.01)

(58) Field of Classification Search
CPC ..... B02C 13/06; B02C 13/28; B02C 13/2804
See application file for complete search history.

(56) References Cited

U.S. PATENT DOCUMENTS 2,588,434 A * 3/1952 Unti ..... B02C 13/2804 241/197
2,635,817 A * 4/1953 Long ..... B02C 13/2804 241/197
2,747,803 A * 5/1956 Benard ..... B02C 13/2804 241/191
3,236,463 A * 2/1966 Ratkowski ..... B02C 13/28 241/197

(Continued)

FOREIGN PATENT DOCUMENTS

CN 2354662 Y 12/1999
CN 101223091 A 7/2008

(Continued)

OTHER PUBLICATIONS

European Search Report dated Aug. 3, 2018 with respect to counterpart European patent application EP 18 17 7911.

(Continued)

*Primary Examiner* — Faye Francis
(74) *Attorney, Agent, or Firm* — Henry M. Feiereisen LLC

(57) ABSTRACT

An impact bar for installation in an axis-parallel impact bar mount of a rotor of an impact crusher includes front-side and backside holding regions between end faces, and longitudinal ribs projecting beyond the end faces. Each holding region is bordered by two longitudinal ribs which have a trapezoidal cross section to define a base and a topside at a distance to the base, with the base being wider than the topside. The longitudinal ribs have each an inner inclined (Continued)

flank and an outer flank, with the inner and outer flanks extending between the base and the topside and with the inner flank extending at a flank angle of 20° to 27° in relation to the x direction and configured such that only the inner flank is supportable in the installation position for transmission of a force into the impact bar mount at the rotor.

22 Claims, 4 Drawing Sheets

(56) References Cited

U.S. PATENT DOCUMENTS 3,510,076 A * 5/1970 Perdue ..... B02C 13/28 241/197
3,608,841 A * 9/1971 Wageneder ..... B02C 13/095 241/189.1
3,838,826 A * 10/1974 Wallace ..... B02C 13/2804 241/197
3,929,296 A * 12/1975 Stoeber ..... B02C 13/2804 241/197
3,979,078 A * 9/1976 Boddeker ..... B02C 13/2804 241/191
4,180,213 A * 12/1979 Endo ..... B02C 13/2804 241/191
4,373,678 A * 2/1983 Reitter ..... B02C 13/2804 241/189.1
4,714,207 A * 12/1987 Schrodl ..... B02C 13/2804 241/189.1
4,848,682 A * 7/1989 Scheler ..... B02C 13/06 241/190
4,915,309 A * 4/1990 Schmidt ..... B02C 13/2804 241/191
5,111,569 A * 5/1992 Ostergaard ..... B02C 13/2804 29/407.05
6,845,933 B2 * 1/2005 Stemper ..... B02C 13/2804 241/189.1

FOREIGN PATENT DOCUMENTS

| | | | |
|---|---|---|---|
| CN | 201140084 | Y | 10/2008 |
| CN | 103084238 | A | 5/2013 |
| CN | 203108613 | U | 8/2013 |
| CN | 203155297 | U | 8/2013 |
| CN | 205032226 | U | 2/2016 |
| DE | 2811376 | A1 | 9/1979 |
| DE | 2906303 | A1 | 8/1980 |
| DE | 3525442 | A1 | 1/1987 |
| DE | 202017103587 | U1 | 7/2017 |
| JP | S58174245 | A | 10/1983 |
| JP | S 61 132042 | U | 8/1986 |
| JP | H09299818 | A | 11/1997 |

OTHER PUBLICATIONS

Translation of European Search Report dated Aug. 3, 2018 with respect to counterpart European patent application EP 18 17 7911.
Chinese Search Report dated Jan. 16, 2020 with respect to counterpart Chinese patent application 201810628223.0.
Translation of Chinese Search Report dated Jan. 16, 2020 with respect to counterpart Chinese patent application 201810628223.0.

* cited by examiner

IMPACT BAR

CROSS-REFERENCES TO RELATED APPLICATIONS

This application claims the priority of German Patent Application, Serial No. DE 10 2017 113 238.4, filed Jun. 16, 2017, pursuant to 35 U.S.C. 119(a)-(d).

BACKGROUND OF THE INVENTION

The invention relates to an impact bar for an impact crusher and to a rotor with such an impact bar as well as to an impact crusher.

Impact crushers are used for comminuting mineral materials (natural stone or recycling material) and for the production of fine or coarse aggregate. For this purpose, the material is moved in free fail to the effective region of impact bars of a rotor and hurled from there against impact plates. It is smashed there. The impact bars represent wearing parts and must be replaced periodically. Reversible impact crushers permit a change in the rotation direction of the rotor, so that the front and backsides of the impact bars can be used alternatingly, until the wear limit has been reached. Thereafter, the impact bars can be turned about their own length axis. An end zone of the impact bars that has not yet worn off and is located in an impact bar mount in the rotor thus advances outwards, so that the impact bar can be used until also this end zone reaches the wear limit. In terms of the utilization factor of the used material, it is desirable to keep the holding region of the impact bars as small as possible and to keep the impact region that is exposed to wear as large as possible. However, when the holding region is too small, the impact bar may be exposed to high stress. The impact bar may break, causing damage to further parts of the impact crusher. Repair works and production downtimes are the result. When the holding region is too large, significant material parts of the impact bar may not be used for contact with the material to be comminuted. A low utilization factor is not economically viable.

SUMMARY OF THE INVENTION

The invention is based on the object to provide for an impact crusher an impact bar which has a long service life and high utilization factor. In addition, an appropriate rotor shall be provided for such an impact bar as well as an impact crusher with a rotor having longer service life.

According to one aspect of the present invention, the object is achieved by an impact bar for installation in an axis-parallel impact bar mount of a rotor of an impact crusher with following features:

a. the impact bar includes within a Cartesian coordinate system a longitudinal axis which extends in z direction in parallel relation to the impact bar mount in the installation position, a vertical axis which extends in y direction and is directed towards a radial head face of the impact bar, and a transverse axis which extends in x direction and is directed towards a length side of the impact bar, b. the impact bar includes on each of its length sides two terminal end faces and a front-side and a backside holding region between the end faces, with the holding regions being each bordered by two longitudinal ribs which project beyond the end faces, with the longitudinal ribs being arranged as mirror images in relation to the y-z plane and the x-z plane, c. the longitudinal ribs are trapezoidal in cross section, with a wider base at the impact bar and a narrower topside at a distance to the base, and respectively have an inner inclined flank and an outer flank, with the flanks extending between the base and the topside and with the inner flanks extending at a flank angle of 20° to 27° in relation to the x direction, d. only the inner flanks are supportable in the installation position for transmission of forces into the impact bar mount at the rotor.

According to another aspect of the present invention, the object is achieved by a rotor including at least two impact bars as set forth above, wherein the impact bar mount includes confronting impact bar clamps with projections in order to engage between the longitudinal ribs, with the projections having the same flank angle as the inner flanks of the longitudinal ribs.

According to still another aspect of the present invention, the object is achieved by an impact crusher including a rotor as set forth above, wherein the impact crusher is reversible.

A turnable impact bar is proposed for use in an axis-parallel impact bar mount of an especially reversible rotor of an impact crusher. A maximum utilization factor is established when the impact bar can be turned. The impact bar includes a holding region in the middle and respective impact zones adjacent to the holding region. One of the two impact zones at the end faces of an impact bar is situated in a use position, i.e. it projects beyond the rotor. The other impact zone is situated in the rotor in a protected manner and may be transferred to the use position by turning the impact bar.

The impact bar has within a Cartesian coordinate system a longitudinal axis which extends in z direction in parallel relation to the impact bar mount of the rotor, when assuming the installation position, a vertical axis which extends in y direction and is directed towards a radial head face of the impact bar, and a transverse axis which extends in x direction and is directed towards a length side of the impact bar. The origin of this coordinate system is located in the middle of the cross sectional area of the impact bar.

The impact bar includes on each of its length sides (front side and backside) two terminal end faces which provide impact surfaces, and a front-side and a rear-side holding region between the end faces. Which side is the front side and which side is the backside depends on the installation position and on the rotation direction of the rotor. The invention is based on identical front and backsides in relation to the effective areas there. This enables a reversible operation of the rotor, without the reversal of the impact bar requiring a turning thereof by hand.

The holding regions are bordered by two identical longitudinal ribs, respectively, i.e. the holding regions are situated between the longitudinal ribs. The longitudinal ribs project beyond the end faces. The longitudinal ribs are mirror images of one another in relation to the y-z plane and to the x-z plane. The impact bar is rotationally symmetrical as a result. It can be turned by 180° about the x, y, or z axis and thus forms an image of itself.

The longitudinal ribs have a trapezoidal cross section. They have a broad base on the impact bar and a narrower topside at a distance to the base. The topside extends parallel to the y-z plane. Also the end faces extend substantially parallel to the y-z plane. "Substantially" relates in this context "within the scope of manufacturing tolerances". The impact bar may involve in particular a cast part. Cast parts have surfaces which for manufacturing reasons are slightly inclined or uneven. The invention covers surfaces, which are produced through casting, as well as surfaces which underwent forming or material removing processes, e.g. forged or milled surfaces. The impact bar according to the invention can be made of a metallic cast material, a ceramic material, or a hybrid material of steel with ceramic proportions. The invention is not limited to a particular material, so long as this material is able to crush mineral material with sufficient service life.

The trapezoidal longitudinal ribs have each two flanks which extend from the base to the topside. The confronting inner flanks of adjacent longitudinal ribs define a flank angle of 20° to 27° in relation to the x axis. In particular the flank angle is 23° to 26° and preferably 25°. This flank angle has proven to be especially appropriate for the transmission of forces from the impact bar onto the rotor and for the transmission of the torque from the rotor onto the impact bar.

Preferably, not only are the flank angles of both inner flanks on a length side identical but also the flank angles of both outer flanks. In addition, the flank angles of the inner and outer flanks can be identical and also amount to 20° to 27°, in particular 23° to 26°, preferably 25°.

The outer flanks have this angle that deviates by approx. 25° from the x axis so that the forces introduced into the longitudinal ribs have to be deflected at the transition from the base to the flanks not by 90° but rather by about 65°. In addition, the transitions of the flanks to the base are rounded, a fact that also prevents stress peaks in the material.

The impact bar has a width which is measured in x direction and is at least as great between the longitudinal ribs as the width in the region of the end faces. Preferably, the width between the longitudinal ribs is greater than the width in the region of the end faces, in particular in the magnitude of 4 to 10%. The width of the impact bar in the impact zone deviates only relatively slightly from the width between the longitudinal ribs, e.g. 80 mm/85 mm or 100 mm/108 mm (width end faces/width between the longitudinal ribs). The greater width between the longitudinal ribs is appropriate because the longitudinal ribs are exposed to higher loads, when the force is introduced in the manner according to the invention and because the loads on the longitudinal ribs should be transmitted onto the further longitudinal ribs via the central region of the impact bar with as little stress as possible. The central region of the impact bar between the longitudinal ribs should therefore have a greater width.

The invention is based on the fact that the width of an impact bar that is not worn off is substantially constant in both the region of the end faces and between the longitudinal ribs.

The holding region relates within the scope of the invention to the one region in which the impact bar is clamped. It begins on an upper contact zone at the outer longitudinal rib and ends on a lower contact zone at the lower longitudinal rib. The impact bar is clamped between the longitudinal ribs through formfitting engagement.

The invention avoids a weakening of the cross section of the impact bar as a result of lateral notches. The different widths effect that the central region between the longitudinal ribs appear like a depression, when in fact the cross section of the impact bar is not weakened but rather even reinforced. The is no notch effect. The provision of more material in the central region creates the basis for a secure anchoring of a turnable impact bar. The combination of the slightly wider central region with these flank angles of the inner flanks enables an impact bar which requires as a result less material while having higher stress resistance and therefore attains a high utilization factor of at least 50%. Preferably, the utilization factor is greater than 55% and in particular greater than 60%.

As a result of the width differences, the confronting inner flanks of the longitudinal ribs are shorter than the outer flanks, so long as the inner and outer flanks have the same flank angle. During operation, centrifugal forces are transmitted via the inner flanks of the radially inner longitudinal ribs onto the impact bar clamps in the impact bar mount. The impact bars effect very high centrifugal forces due to their high own weight and high rotation speeds. The formfitting engagement between rotor and impact bars effects a secure fixation in radial direction of the rotor. Still, the impact bars can be replaced at standstill in a mechanically simple manner because of their sole contact with the rotor via the flanks of the longitudinal ribs. The impact bars may be pulled out of the impact bar mounts. As the axial stress is fairly slight, simple fixing means are sufficient to effect the axial securement, such as, e.g. axial safeguards that are screwed onto the rotor. They are easy to detach and enable a direct access to the impact bar.

The impact bar mount is bordered on both sided by impact bar clamps. The impact bar clamps are welded to the rotor. The rotor may be constructed from several rotor disks arranged in parallel relationship, with the impact bar clamps extending from rotor disk to rotor disk. The impact bar clamps are those components with which the impact bars are in contact via their flanks.

The inner flanks of the radially inner longitudinal ribs are not exposed to stress by the centrifugal forces but primarily by the fact that the material to be comminuted impacts the impact bar and is greatly accelerated by the impact bar. As the impact circle of the rotor is greater than the rotor itself, torque is exerted upon the impact bar. This torque is transmitted via the flanks of the longitudinal ribs into the rotor. Conversely, the driven rotor transmits forces into the impact bar clamps which in turn transmit the forces via these flanks into the longitudinal ribs of the impact bar. The inner confronting flanks of the longitudinal ribs are in addition to the impact surfaces the most important surfaces of the impact bars as they, and only they in accordance with the invention, participate in the force transmission. It is not excluded within the scope of the invention for the mineral material that has penetrated gaps and joints between impact bar and impact bar clamp to effect an additional or indirect force transmission. The forces are transmitted predominantly via the flanks.

As the material breaks, primarily the radially inner flank of the radially outer longitudinal rib is under stress on the backside of the impact bar. On the front side, it is the inner flank of the radially inner longitudinal rib during breakage. In accordance with the invention, the flanks are oriented such that the torques to be absorbed impact about the longitudinal axis (rotation axis/z axis) onto surfaces which extend in radial direction towards the rotation axis. Ideally is when these surfaces are spaced at great radial distance to the rotation axis. The lever arm is increased and as a result surface pressure is reduced at the support point, i.e. the force vector becomes smaller. In accordance with the invention, a great lever arm is established while the impact bar is slender, when the flanks providing support points or support surfaces have a great radial distance from the longitudinal axis (z axis). So that the utilization factor remains high at the same time, the longitudinal ribs may not be too wide/high. Optimally, the flanks are arranged at an angle of 20° to 27° and lie in a radial; plane which intersects the longitudinal axis. Due to the symmetry, the intersecting radial planes of the four inner flanks extend at an angle of 2×20°-27°=40°-52° in relation to one another, preferable 50°. The inner flanks are arranged virtually x-shaped in relation to the center point of the impact bar or z axis, about which the torque is applied and which lie in the same plane in which the diametrically arranged inner flanks are located.

In final analysis, the introduced torques are absorbed in this configuration by the impact bar clamps in an optimum manner. Bending moments in the longitudinal ribs are reduced and wear as well as material stress are diminished. Risk of breakage decreases so that the central region between the longitudinal ribs can be configured smaller in relation to the overall impact bar, thereby enhancing the utilization factor.

In the installation position, both radially outer flanks can form a shoulder for protection of adjacent components of the rotor. The radially outer flanks may for this purpose wear off to a certain degree. This does not adversely affect the function of the impact bar because the outer flanks have no contact areas with the rotor. A deviation of the dimensional precision or wear in this region does not impair the secure fit or service life of the impact bar.

A geometry of the impact bar is viewed as especially beneficial, when the ratio between the width of the impact zone and the minimum distance of the flanks in the central region is 1.8-2.2 to 1, in particular 2 to 1. This width in the impact zone is preferably greater than 70 to 80 mm. The width is in particular constant across the entire impact zone.

The ratio between the minimum distance of the inner flanks between the longitudinal ribs and the height of the longitudinal ribs is preferably 1.8-2.2 to 1, in particular 2 to 1.

The longitudinal ribs should have a width in x direction of 40%-60%, in particular 50%, in relation to the height of the impact bar. Their topsides should have a height in y direction of preferably 40%-60%, in particular 50%, in relation to the minimum distance of the inner flanks between the longitudinal ribs. The width of the impact bar in the region of the longitudinal ribs is greater by preferably 40%-60%, in particular 50%, than the width of the impact bar in the impact zone. The length of the impact bar in z direction is independent on other proportions.

The invention proposes for securement an appropriate rotor in which the impact bar mount includes opposing impact bar clamps with projections in order to engage between the longitudinal ribs. The projections have in this case the same flank angles as the inner flanks of the longitudinal ribs. As a result, the surface pressure is kept as small as possible, that is on both the rotor and the impact bar. The material is used in an optimum manner while stress is even. Thus, material can be saved on the rotor and on the impact bar.

According to an advantageous refinement of the invention, protective rotor plates are arranged on the rotor to radially cover the impact bar clamps about their circumference. The protective rotor plates are replaceable wear parts, which, however, have a much longer service life than the impact bars, because they are exposed to less stress. The protective rotor plates can be placed in accordance with the invention in very close proximity to the impact bar. A border side of a protective rotor plate is arranged preferably directly in opposition to the topsides of the radially outer longitudinal ribs. Thus, the topsides of the radially outer longitudinal ribs, up to which topsides the end faces wear off, are protected in an optimum manner, so that the impact bars can wear off in a maximum manner without damage to their longitudinal ribs.

The contact zone between the impact bar and the impact bar clamps is very limited in height. The radially innermost contact zones between the impact bar and the impact bar clamps are situated at the inner flanks of the radially inner longitudinal ribs. Conversely, the radially outermost contact zones between the impact bar and the impact bar clamp are situated at the inner flank of the radially outer longitudinal ribs. Although the contact zone between rotor and impact bar is very concentrated; still the diametric disposition of the flanks as support faces and the resultant greater lever arms are able to transmit very large forces and torques.

In accordance with a refinement of the invention, the impact bar mount can include a radially inner region for receiving the second end face or second impact section of the impact bar, with this region widening in x direction, and a region which is narrower in x direction and situated between the projections. It is located further radially outwards. A rounded transition zone is arranged between these regions and extends across at least 50% of the width of the topside of the inner longitudinal ribs. The rounded zone is very large so as to prevent as much as possible formation of notch stress in this region. The topsides of the longitudinal ribs do not touch the inner regions of the impact bar mount and therefore do not transmit any forces. In view of the longitudinal ribs that directly confront one another in pairs, broad shoulder belts are established which transmit the centrifugal forces of the impact bar into the rotor.

The impact bar according to the invention has the following advantages:

In the installation position, the confronting radially outer longitudinal ribs form a region of maximum width as shoulder belt. The greatest torques of the impact bar are applied at the radially outer shoulder belt. They are effectively introduced into the adjacent regions as a result of the optimized flank geometries. The broad shoulder also protects the rotor itself even against wear.

The impact bar is profiled in a simple manner, has clear proportions and therefore is cost-effectively to produce.

The impact bar has a greatest possible support width due to the diametrically arranged flanks of orientation in same direction, so that stress on the impact bar is reduced.

The greatest possible radius in the impact bar mount prevents stress peaks in the impact bar clamp and provides highest stability.

The flank angle of approx. 20 to 27°, preferably 25°, has the advantage that the deflection forces within the impact bar mount are small. As the flank angle increases, also the deflection forces would increase, i.e. the forces that act transversely to the impact bar mount. Flank angles below 20° would enlarge the width of the impact bar, when the radial distance of the flanks remains the same, thereby decreasing the utilization factor. When the width should not be made greater, the radial distance of the flanks needs to be made smaller, resulting in shorter lever arms and higher surface pressure. The range between 20° and 27° has been viewed as optimal.

Forces acting on the impact bar are introduced via the radially inner longitudinal ribs at these flank angles far inside the rotor interior into the rotor. This reduces stress on the outer circumferential area of the rotor and improves material usage.

The rotor may be equipped with two, three or more identical impact bars which are evenly dispersed about the circumference. It is also possible to combine impact bars of different height, e.g. two impact bars of greater height with two impact bars of smaller height in alternating disposition.

The impact bars find application in particular in reversible impact crushers. Use in non-reversible impact crushers is also possible.

BRIEF DESCRIPTION OF THE DRAWING

Exemplary embodiments of the invention will be described hereinafter in greater detail with reference to purely schematic drawings.

It is shown in.

DETAILED DESCRIPTION OF PREFERRED EMBODIMENTS

Figure 1:
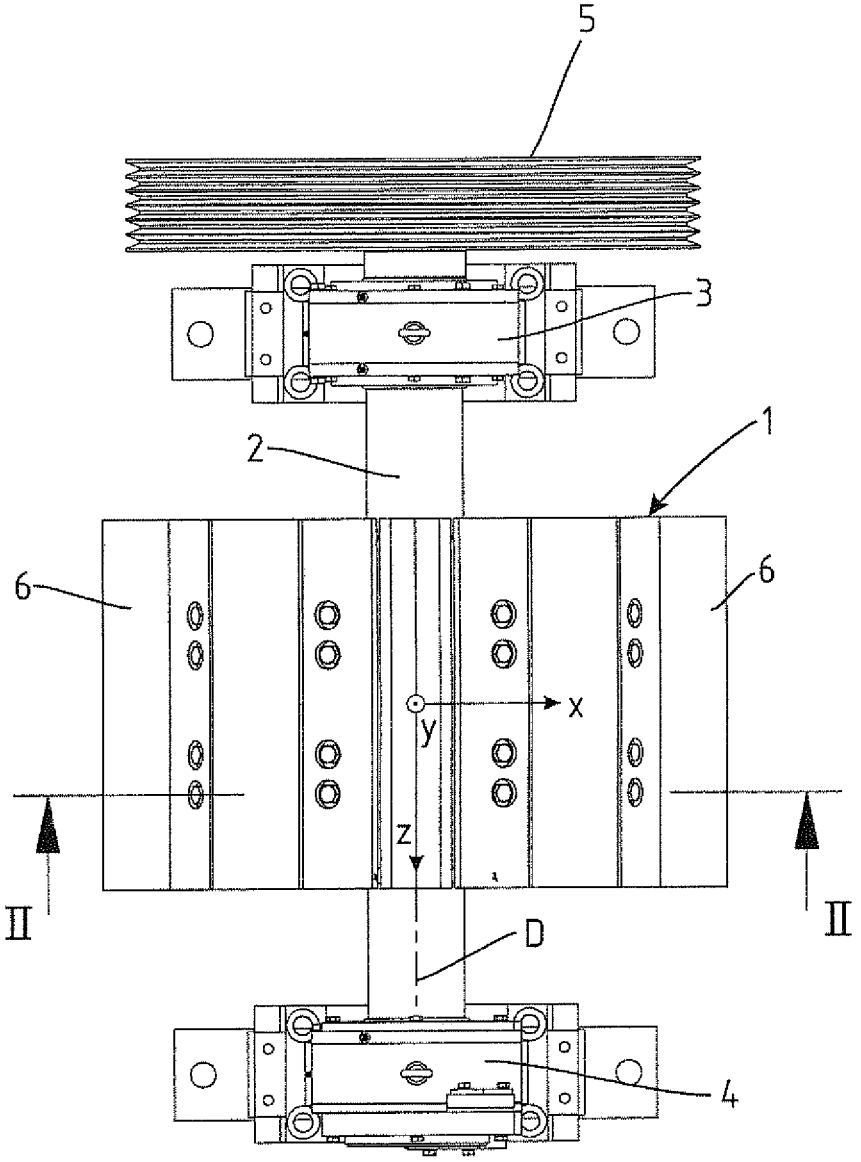
FIG. 1 a plan view of a rotor of an impact crusher.

FIG. 1 shows a rotor 1 of an otherwise not shown impact crusher. The rotor 1 includes a horizontal rotor shaft 2 which is mounted in bearings 3, 4. The rotor shaft 2 extends horizontally between the bearings 3, 4 and is driven by a pulley 5. Impact bars 6 are dispersed about the circumference of the rotor 1. The uppermost impact bar 6 in the drawing plane of FIG. 1 extends like all other impact bars 6 in parallel relation to the rotation axis D of the rotor shaft 2.

The following description of the impact bars 6 relates to a Cartesian coordinate system. The origin of the coordinate system is situated in the middle of the impact bar 6, i.e. at half length (z axis), height (y axis) and width (x axis) of this impact bar 6. Referring to the impact bar 6 which is uppermost in the drawing plane and perpendicular to the rotation axis D, the x direction extends tangentially to the rotor 1. The y axis is the radial direction and points away from the rotor shaft 2. The z axis extends parallel to the rotation axis D.

Figure 2:
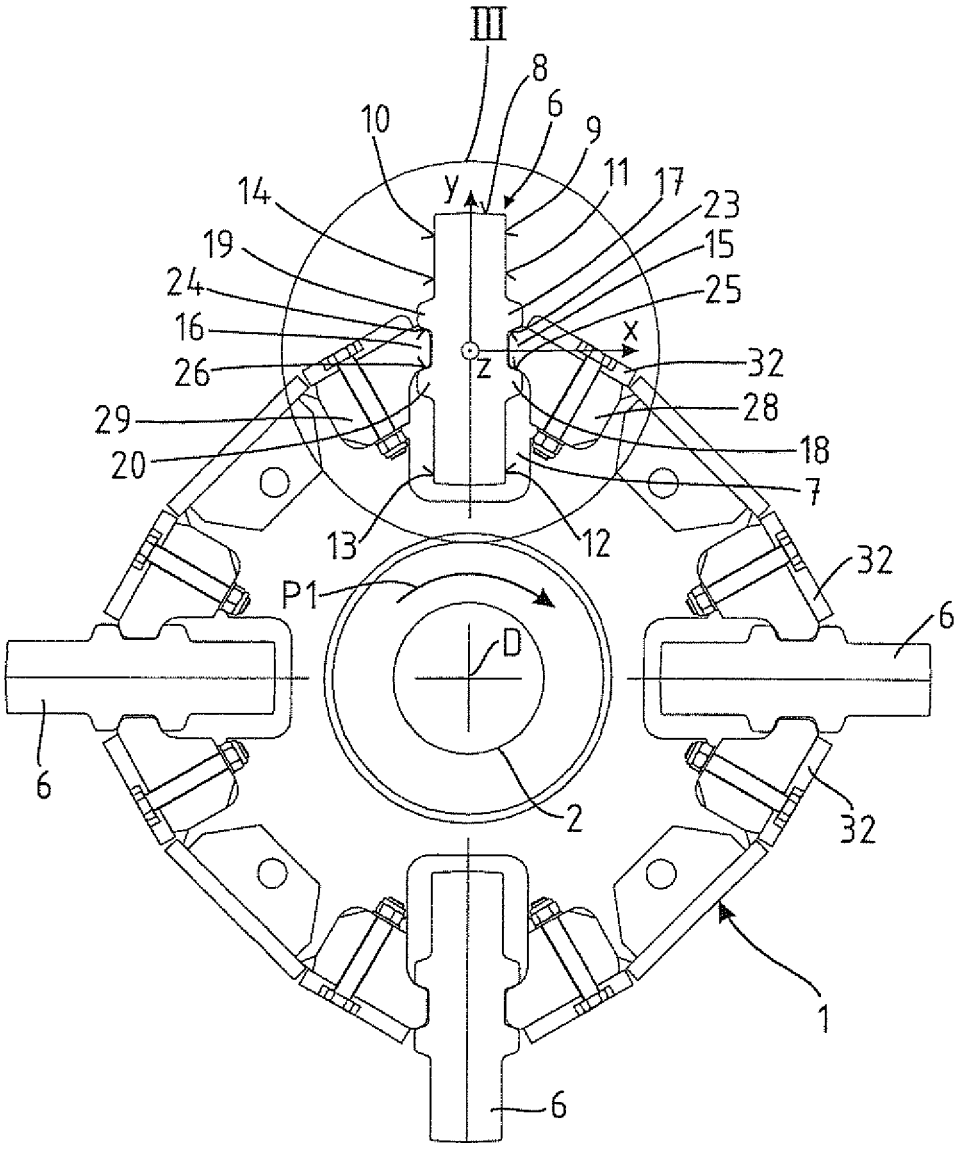
FIG. 2 a section through the rotor of FIG. 1 along the line II of FIG. 1.

As is apparent from the sectional view of FIG. 2, a total of four impact bars 6 are evenly dispersed about the circumference of the rotor 1. The four impact bars 6 are identical, as are the associated impact bar mounts 7 within the rotor 1. The impact bar mounts 7 represent pockets that extend in length direction of the rotor, i.e. parallel to the rotation axis D of the rotor shaft 2. With reference to the coordinate system introduced in FIG. 1, the pockets extend in z direction.

The impact bars 6 are configured in cross section substantially rectangular. With reference to the y-z plane and also with reference to the x-z plane, the impact bars are mirror images. They have each radial head faces which extend in substantial parallel relation to the x-z plane. As the impact bars 6 involve cast parts, the head faces 8 may have a slight draft as caused by casting. The length sides 9, 10 of the impact bar 6 extend at a parallel distance to one another and as a result extend substantially perpendicular to the head faces 8.

Two terminal end faces 11, 12, 13, 14 are situated at the length sides 9, 10 and provide impact surfaces. Provided between the end faces 11-14 of each length side 9, 10 are undercuts, respectively, which are designated as holding regions 15, 16. The holding regions 15, 16 are respectively limited by two longitudinal ribs 17, 18, 19, 20 as is apparent also by the illustration of FIGS. 2 to 4. All longitudinal ribs 17-20 are of identical configuration and have the same cross section. The longitudinal ribs 17-20 have a trapezoidal cross section and a have a wider base 21 and a narrower topside 22 (FIG. 4). Inclined flanks extend between the base 21 and the topside 22. Inner flanks 23-26 confront one another and limit the holding regions 15, 16. Outer flanks 27 form the transition to the end faces 11-14. All edges are rounded.

Arrow P1 in FIG. 2 symbolizes the rotation direction of the rotor shaft 2 and thus of the rotor 1. Due to the rotation direction, the end face 11 represents the impact surface that is subject to stress. At this rotation direction, also the designations front side and backside of the impact bar 6 could be used. As the rotation direction is reversible, the opposite end face 14 may likewise serve as impact surface, when operation is reversed.

A rotary movement is transmitted via the rotor 1 and the impact bar mounts 17 onto the impact bars 6. The impact bars 6 are pushed into the impact bar mounts 7 in a manner not shown in greater detail in z direction, i.e. in length direction of the rotor 1. The impact bars are secured in the installation position against axial displacement. As a result of the formfitting engagement of impact bar clamps 28, 29 between the longitudinal ribs 17-20, the impact bars 6 are held captive in the rotor 1. The impact bar clamps 28, 29 rest upon the inner flanks 23-26 of the impact bar 6, respectively. Due to the inclined inner flanks 23-26, the undercut region, i.e. the respective holding region 15, 16, has a trapezoidal cross section with rounded corners.

Figure 3:
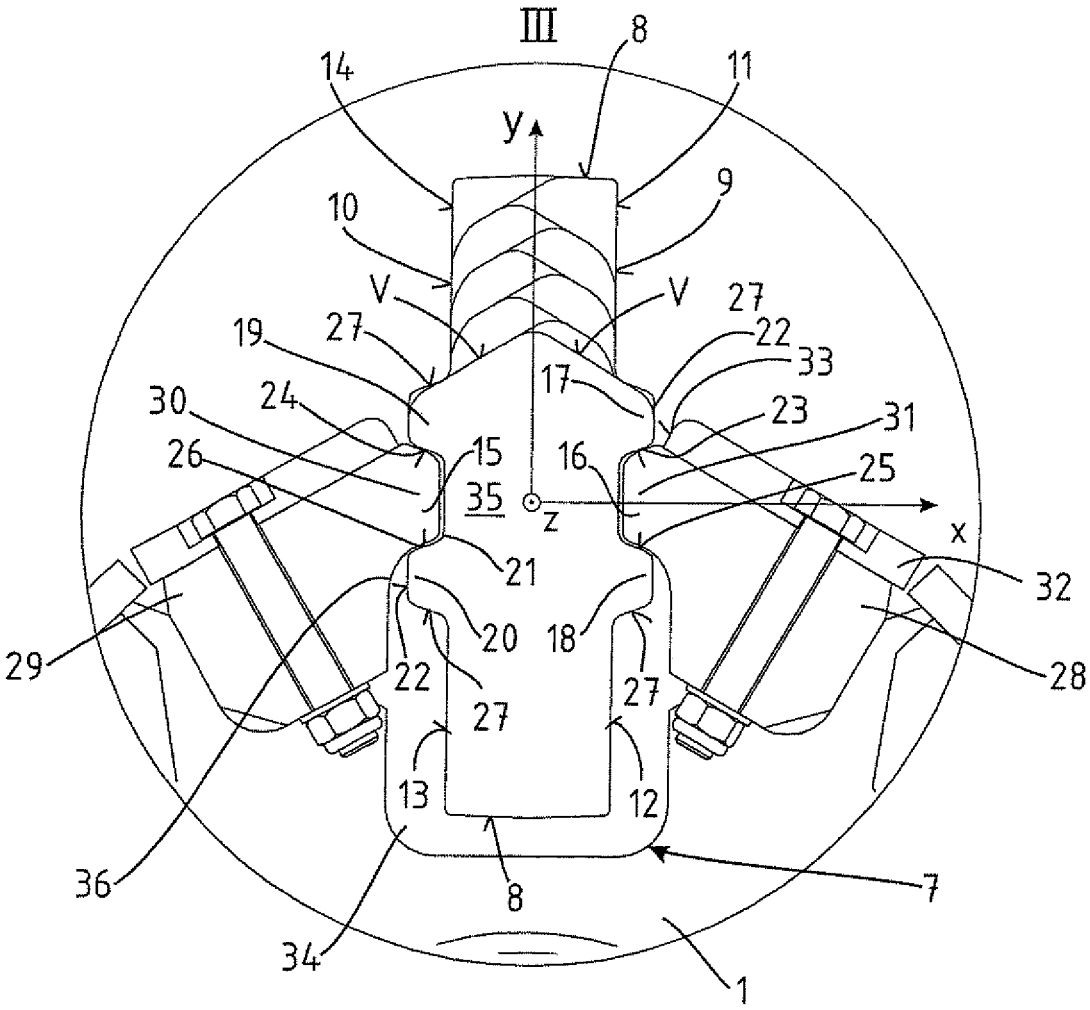
FIG. 3 a detail III of FIG. 2.
Figure 4:
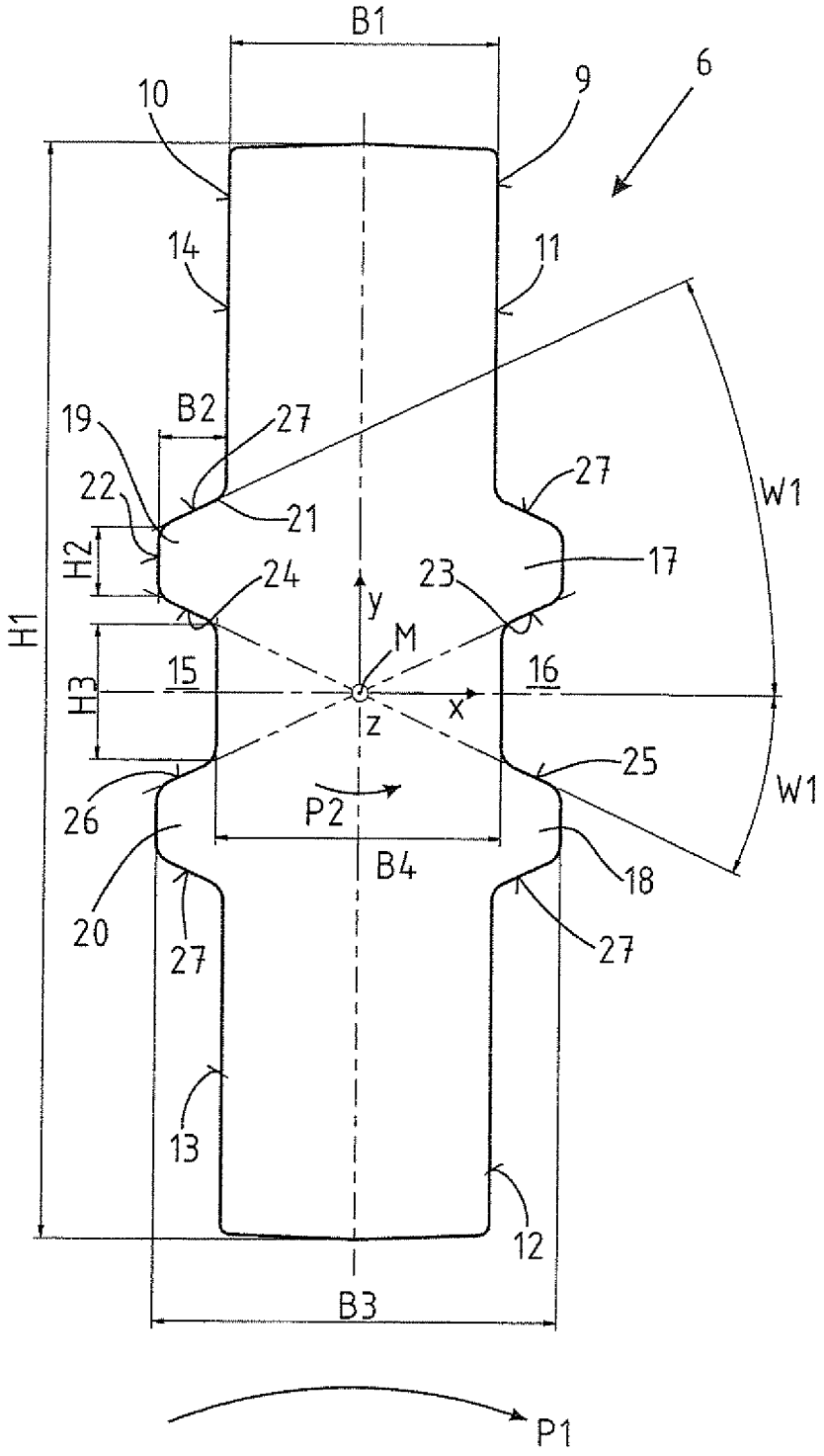
FIG. 4 a cross section of an impact bar.

As becomes apparent from the enlarged illustration of FIG. 3, a contact zone is established between the flanks 23-26 and the impact bar clamps 28, 29. The impact bar clamps 28, 29 have for that purpose opposing identical projections 30, 31 with a geometry and in particular with support faces which conform to the flank angles of the inner flanks 23-26. The flank angle W1 is depicted in FIG. 4.

FIG. 3 shows that the radially outermost contact zone between the impact bar clamps 28, 29 and the impact bar 6 is formed by the radially inner flanks 23, 24 of the radially outer longitudinal ribs 17, 19. Likewise, the radially innermost contact zones are located between the inner flanks 25, 26 and the respective projections 30, 31 of the impact bar clamps 28, 29. There are no further contact zones radially above or below the mentioned regions. Thus, the radial outer longitudinal ribs 17, 19 project beyond the impact bar clamps 28, 29 and radially rest virtually from outside against the rotor 1. They are protected by protective rotor plates 32 which are screwed onto the rotor 1 radially from outside. The protective rotor plates 32 cover the impact bar clamps 28, 29 and protect them against wear. The protective rotor plates 32 have each a border side 33 which confronts the topsides 22 of the longitudinal ribs 17, 19. In this way, the longitudinal ribs 17, 19 are protected in this region against wear. The protective rotor plates 32 are detachably secured.

FIG. 3 shows an enlarged view of the area III according to FIG. 2. Various wear lines are plotted in the radially outer part of the impact bar 6. The wear lines show that the rotor 1 has been operated at the beginning counterclockwise, since the left upper corner of the impact bar 6 has been stripped off at first. Subsequently, the rotation direction has been reversed, so that the end face 11 on the right-hand side of the drawing plane serves as impact surface. Thus, the right upper corner of the impact bar 6 has been stripped. After multiple reversals of the rotor 1, the wear limit V has been reached. The wear limit V is located approximately in prolongation of the radially outer flanks 27. The wear limit V is the limit for maximum use of the impact bar 6. The impact bar 6 has in this state an approximately triangular remaining cross section at the wear limit V.

When the wear limit V has ultimately been reached, the impact bar 6 is pulled out of the impact bar mount 7 in length direction of the rotor 1 and can be turned about its length axis, so that the previously inner end faces 13, 14 now face outwards. There is no preferential direction of the impact bar 6, when turning by 180 degrees. It is irrelevant, whether the impact bar 6 is turned about its length axis only, or turned at the same time during turning about its vertical axis. The rotational symmetry of the impact bar 6 enables both insertion directions into the impact bar mount 7.

FIG. 3 shows that the impact bar mount 7 is configured relatively wide in the region of the impact bar 6 that is not in engagement. In the impact bar mount 7, there is an inner region 34 which is widened in x direction. The width of this inner region 34 is greater than the width of the impact bar 6, measured across the longitudinal ribs 18, 20. A region 35 that is narrower in x direction is situated between the projections 30, 31. The wider region 34 is connected to the narrower region 35 by a transition zone 36. The transition zone 36 is rounded. Rounding of the transition zone 36 extends across at least 50% of the height of the topside 22 of the inner longitudinal ribs. The provision of the great rounding radius prevents stress in this region of the impact bar clamps 28, 29. This is important because this region of the impact bar clamps 28, 29 needs to absorb not only the centrifugal forces that are exerted from the impact bar 6 onto the rotor 1 but also because the torque of the rotor 1 has to be transmitted from the impact bars 6 onto the material being comminuted. The impact bar according to the invention includes for this purpose special proportions which will be described hereinafter with reference to FIG. 4.

The impact bar 6 includes in this exemplary embodiment a height H1 of 320 mm at a width B1 in its impact zone of 80 mm. The ratio of height to width is 4:1.

The impact bar 6 is slightly wider in its mid mounting portion that is not subject to wear than in the impact zone. The longitudinal ribs 17-20 have each a height of 20 mm, measured from the terminal end faces 11-14 (width B2). Their topsides 22 have a height H2 of 20 mm. The height H3 is measured at the base 21 and indicates the minimum distance of the inner flanks 23-26 of the longitudinal ribs 17-20.

FIG. 4 further shows that the flank angles W1 are identical for all plotted flanks of the longitudinal ribs 17-20. They amount to 25 degree. The inner flanks 23-26 extend each radially from a center point M of the impact bar 6. Thus, the illustrated dash-dot lines intersect as prolongation of the respective inner flanks 23-26 in the center point M. The center point M lies on the length axis of the impact bar 6 (z axis), about which the mounted impact bar 6 can theoretically swing within the impact bar mount 7 during operation within the scope of the provided tolerances.

When a clockwise rotation direction of the rotor 1 is involved, i.e. in direction of arrow P1 (FIG. 2), a force originating from rotor 1 is applied onto the inner flanks 24, 26. At the same time, both radial inner flanks 25, 26 of the lower longitudinal ribs 18, 20 maintain the impact bar 6 in position. The centrifugal forces of the impact bar 6 are absorbed there. When impacting material exerts a force onto the end face 11, predominantly the upper longitudinal rib 19 on the left-hand side of the drawing plane and in addition the longitudinal rib 18 on the lower right-hand side are exposed to stress, because a torque in direction of arrow P2 about the center point M is applied upon the impact bar 6. The resultant forces are taken up via these inner flanks 25, 26 and introduced into the impact bar clamps 28, 29. This involves normal forces, i.e. forces which extend perpendicular upon the flanks.

FIG. 4 further shows that the width B3 of the impact bar 6, which is measured across the topsides 22 of the longitudinal ribs 18, 20, is sized 1.5 times the width B1 of the impact bar 6 in the region of its impact zone. In the holding region 15, 16 in the middle of the impact bar 6, the width B4 is sized at least as the width B1 in the region of the end faces 11, 12, thereby preventing the presence of any notch as material weakening. In this exemplary embodiment, the width B4 in the region between the longitudinal ribs 17-20 is 85 mm as compared to 80 mm in the impact zones.

What is claimed is:

1. An impact bar for installation in an axis-parallel impact bar mount of a rotor of an impact crusher, said impact bar defining within a Cartesian coordinate system a longitudinal axis which extends in z direction in parallel relation to the impact bar mount in an installation position, a vertical axis which extends in y direction and is directed towards a radial head face of the impact bar, and a transverse axis which extends in x direction and is directed towards a length side of the impact bar, said length side of the impact bar having end faces, said impact bar comprising:

front-side and backside holding regions between the end faces; and longitudinal ribs projecting beyond the end faces, each of the front-side and backside holding regions being bordered by two of the longitudinal ribs, said longitudinal ribs being arranged as mirror images in relation to an y-z plane and an x-z plane and having a trapezoidal cross section to define a base and a topside at a distance to the base, with the base having a width which is greater than a width of the topside, said longitudinal ribs having each an inner inclined flank and an outer flank, with the inner and outer flanks extending between the base and the topside and with the inner flank extending at a flank angle of 20° to 27° in relation to the x direction and configured such that only the inner flank is supportable in the installation position for transmission of a force into the impact bar mount at the rotor.

2. The impact bar of claim 1, wherein the impact bar has a width, measured in the x direction, with the width being sized as great in a region between the two longitudinal ribs as a width in a region of the end faces.

3. The impact bar of claim 1, wherein the inner flanks of the longitudinal ribs are arranged diagonally oppositely in pairs and extend in a common plane.

4. The impact bar of claim 1, wherein the outer flank forms in the installation position a shoulder for protection of an adjacent component of the rotor.

5. The impact bar of claim 1, wherein a cross sectional area of the impact bar has in an x-y plane a wearing part and a non-wearing part, with the wearing part representing at least 50% of the cross sectional area.

6. The impact bar of claim 5, wherein the wearing part has a width, with a ratio between the width of the wearing part of the impact bar and a minimum distance between the inner flanks of the longitudinal ribs being 1.8-2.2 to 1.

7. The impact bar of claim 1, wherein the inner flanks of the two longitudinal ribs are spaced from one another by a minimum distance, with a ratio of the minimum distance between the inner flanks to a height of the longitudinal ribs being 1.8-2.2 to 1.

8. The impact bar of claim 1, wherein a cross sectional area of the impact bar has in an x-y plane a wearing part and a non-wearing part, with the wearing part representing 55% of the cross sectional area.

9. A rotor, comprising:

at least two impact bar mounts; and at least two impact bars received in the at least two impact bar mounts in one-to-one correspondence, each of the impact bars defining within a Cartesian coordinate system a longitudinal axis which extends in z direction in parallel relation to the impact bar mount in an installation position, a vertical axis which extends in y direction and is directed towards a radial head face of the impact bar, and a transverse axis which extends in x direction and is directed towards a length side of the impact bar, said length side of the impact bar having end faces, said impact bar comprising front-side and backside holding regions between the end faces, and longitudinal ribs projecting beyond the end faces, each of the front-side and backside holding regions being bordered by two of the longitudinal ribs, said longitudinal ribs being arranged as mirror images in relation to an y-z plane and an x-z plane and having a trapezoidal cross section to define a base and a topside at a distance to the base, with the base having a width which is greater than a width of the topside, said longitudinal ribs having each an inner inclined flank and an outer flank, with the inner and outer flanks extending between the base and the topside and with the inner flank extending at a flank angle of 20° to 27° in relation to the x direction and configured such that only the inner flank is supportable in the installation position for transmission of a force into the impact bar mount at the rotor, wherein each impact bar mount includes confronting impact bar clamps with projections for engagement between the longitudinal ribs, said projections having a same flank angle as a flank angle of the inner flanks of the longitudinal ribs.

10. The rotor of claim 9, wherein the impact bar has a width, measured in the x direction, with the width being sized as great in a region between the two longitudinal ribs as a width in a region of the end faces.

11. The rotor of claim 9, wherein the inner flanks of the longitudinal ribs are arranged diagonally oppositely in pairs and extend in a common plane.

12. The rotor of claim 9, wherein the outer flank forms in the installation position a shoulder for protection of an adjacent component of the rotor.

13. The rotor of claim 9, wherein a cross sectional area of the impact bar has in an x-y plane a wearing part and a non-wearing part, with the wearing part representing at least 50% of the cross sectional area.

14. The rotor of claim 13, wherein the wearing part has a width, with a ratio between the width of the wearing part of the impact bar and a minimum distance between the inner flanks of the longitudinal ribs being 1.8-2.2 to 1.

15. The rotor of claim 9, wherein the inner flanks of the two longitudinal ribs are spaced from one another by a minimum distance, with a ratio of the minimum distance between the inner flanks to a height of the longitudinal ribs being 1.8-2.2 to 1.

16. The rotor of claim 9, wherein a radially innermost contact zone between the impact bar and the impact bar clamps is located at the inner flanks of radially inner ones of the longitudinal ribs.

17. The rotor of claim 9, wherein a radially outermost contact zone between the impact bar and the impact bar clamps is located at the inner flanks of radially outer ones of the longitudinal ribs.

18. The rotor of claim 9, wherein the impact bar mount has an inner first region which widens in the x direction for receiving one of the end faces of the impact bar, and a second region which is narrower in the x direction than the first region and located between the projections, with a rounded transition zone being arranged between the first and second regions and extending at least 50% of a height of the topside of inner ones of the longitudinal ribs.

19. The rotor of claim 9, further comprising protective rotor plates arranged on the rotor and configured to cover the impact bar mounts in one-to-one correspondence, each said protective rotor plate having a border side which is arranged directly opposite to the topside of the longitudinal ribs.

20. The rotor of claim 9, wherein the impact bars have different heights.

21. The rotor of claim 9, wherein a cross sectional area of the impact bar has in an x-y plane a wearing part and a non-wearing part, with the wearing part representing 55% of the cross sectional area.

22. An impact crusher, comprising a rotor, said rotor comprising at least two impact bar mounts, and at least two impact bars received in the at least two impact bar mounts in one-to-one correspondence, each of the impact bars defining within a Cartesian coordinate system a longitudinal axis which extends in z direction in parallel relation to the impact bar mount in an installation position, a vertical axis which extends in y direction and is directed towards a radial head face of the impact bar, and a transverse axis which extends in x direction and is directed towards a length side of the impact bar, said length side of the impact bar having end faces, said impact bar comprising front-side and backside holding regions between the end faces, and longitudinal ribs projecting beyond the end faces, each of the front-side and backside holding regions being bordered by two of the longitudinal ribs, said longitudinal ribs being arranged as mirror images in relation to an y-z plane and an x-z plane and having a trapezoidal cross section to define a base and a topside at a distance to the base, with the base having a width which is greater than a width of the topside, said longitudinal ribs having each an inner inclined flank and an outer flank, with the inner and outer flanks extending between the base and the topside and with the inner flank extending at a flank angle of 20° to 27° in relation to the x direction and configured such that only the inner flank is supportable in the installation position for transmission of a force into the impact bar mount at the rotor, wherein each impact bar mount includes confronting impact bar damps with projections for engagement between the longitudinal ribs, said projections having a same flank angle as a flank angle of the inner flanks of the longitudinal ribs, wherein the impact crusher is reversible.

* * * * *